US008487203B2

(12) United States Patent
Shin et al.

(10) Patent No.: US 8,487,203 B2
(45) Date of Patent: Jul. 16, 2013

(54) DISCONNECTING SWITCH WITH EARTHING SWITCH

(75) Inventors: Taeyong Shin, Hitachi (JP); Kyuji Yaginuma, Hitachi (JP)

(73) Assignee: Japan AE Power Systems Corporation, Tokyo (JP)

( * ) Notice: Subject to any disclaimer, the term of this patent is extended or adjusted under 35 U.S.C. 154(b) by 225 days.

(21) Appl. No.: 13/182,109

(22) Filed: Jul. 13, 2011

(65) Prior Publication Data

US 2012/0012449 A1 Jan. 19, 2012

(30) Foreign Application Priority Data

Jul. 16, 2010 (JP) ..... 2010-161140

(51) Int. Cl.
*H01H 33/70* (2006.01)

(52) U.S. Cl.
USPC ..... 218/43; 218/68; 218/84

(58) Field of Classification Search
USPC ..... 218/43, 68, 84
See application file for complete search history.

(56) References Cited

U.S. PATENT DOCUMENTS

| | | | | |
|---|---|---|---|---|
| 3,857,006 | A * | 12/1974 | Daimon et al. | 218/84 |
| 3,876,846 | A * | 4/1975 | Graybill | 218/68 |
| 5,128,269 | A * | 7/1992 | Oitate et al. | 436/126 |
| 5,578,805 | A * | 11/1996 | Berger et al. | 218/43 |
| 6,362,444 | B1 * | 3/2002 | Lee | 218/3 |
| 6,400,244 | B1 * | 6/2002 | Bergamo et al. | 335/195 |
| 6,459,569 | B1 * | 10/2002 | Kashima et al. | 361/605 |
| 6,515,247 | B1 * | 2/2003 | Tsuzura et al. | 218/43 |
| 7,518,851 | B2 * | 4/2009 | Tsuchiya et al. | 361/611 |
| 7,911,303 | B2 * | 3/2011 | Morita et al. | 335/174 |

FOREIGN PATENT DOCUMENTS

JP 54-29701 9/1979

* cited by examiner

*Primary Examiner* — Truc Nguyen
(74) *Attorney, Agent, or Firm* — Brundidge & Stanger, P.C.

(57) ABSTRACT

Operating shaft 4 allows disconnecting switch-side and earthing switch-side moving contacts 7*a* and 7*b* to linearly reciprocate with the rotation of operating shaft 4. Operating shaft 4 has two-hole lever 5 allow an arc motion. Each one end of two curved links 6a and 6b is connected to two-hole lever 5 and the other end of two curved links 6*a* and 6*b* is respectively connected to the disconnecting switch-side moving contact or the earthing switch-side moving contact. When the two connecting points are axisymmetric with respect to the bisector, both the disconnecting switch and the earthing switch are in an open state; when two-hole lever 5 moves at a predetermined angle to the disconnecting switch-side, the disconnecting switch is in a closed state; and when two-hole lever 5 moves at a predetermined angle to the earthing switch-side, the earthing switch is in a closed state.

2 Claims, 11 Drawing Sheets

DS : DISCONNECTING SWITCH
ES : EARTHING SWITCH

DS : DISCONNECTING SWITCH
ES : EARTHING SWITCH

DS : DISCONNECTING SWITCH
ES : EARTHING SWITCH

DISCONNECTING SWITCH WITH EARTHING SWITCH

TECHNICAL FIELD

The present invention relates to a disconnecting switch and earthing switch has a 3-position switch portion which is a disconnecting switch with earthing switch (hereafter, referred to as a "3-position switch"), and specifically to a 3-position switch that has a simple structure and can reduce the size of the entire apparatus.

BACKGROUND ART

A gas-insulated switchgear (hereafter, referred to as a "GIS") has devices, such as a breaker, disconnecting switch, earthing switch and the like. The GIS often uses a 3-position switch wherein an earthing switch and a disconnecting switch are united in a sealed tank.

FIG. 5 shows the outline of the 3-position switch that has been commonly used. The 3-position switch is constructed such that in an sealed tank 101 having a tank length of $L_1$, there are provided three-phase main circuit conductors 102 extending in the direction shown in the drawing and a main circuit conductor 103 disposed so that the extended axes thereof intersects with the main circuit conductor 102. Also, the 3-position switch has a disconnecting switch including a disconnecting switch-side fixed contact 110*a* provided on the main circuit conductor 102 side and a disconnecting switch-side moving contact 107*a* that linearly reciprocates in the disconnecting switch-side conductor 103*a*. Furthermore, on the other main circuit conductor 103 and the sealed tank 101 side, there is provided an earthing switch including an earthing switch-side fixed contact 110*b* and an earthing switch-side moving contact 107*b* that linearly reciprocates in the earthing switch-side conductor 103*b*.

Moreover, an operating shaft 104 is rotatably disposed between the disconnecting switch and the earthing switch. A one-hole lever 105 that is connected to the operating shaft 104 and allows an arc motion as shown by the dashed-dotted line is connected to each end of rectilinear links 106*a* and 106*b*; the other end of the rectilinear link 106*a* is connected to the disconnecting switch-side moving contact 107*a*; and the other end of the rectilinear link 106*b* is connected to the earthing switch-side moving contact 107*b*. This structure enables the disconnecting switch-side moving contact 107*a* and the earthing switch-side moving contact 107*b* to linearly reciprocate as the operating shaft 104 rotates.

In the 3-position switch shown in FIG. 5, an angle formed by the central axis line of the disconnecting switch-side conductor 103*a* and the central axis line of the grounding-side conductor 103*b* intersecting with each other (hereafter, referred to as an "open angle") is a blunt angle much larger than 90 degrees. Therefore, there was a problem in that the tank length $L_1$ of the sealed tank 101 becoming large, increasing the size of the entire GIS.

Accordingly, as shown in FIG. 6, it is considered possible to make the tank length $L_2$ of the sealed tank 201 approximately 80% of the length of the tank shown in FIG. 5 by making an open angle between the disconnecting switch-side conductor 203*a* and the grounding-side conductor 203*b* nearly a right angle. However, in this structure, at the initial motion of the disconnecting switch-side moving contact 207*a* and the earthing switch-side moving contact 207*b*, the frictional force between the disconnecting switch-side moving contact 207*a* and the cylindrical sliding surface of the disconnecting switch-side conductor 203*a* as well as the frictional force between the earthing switch-side moving contact 207*b* and the cylindrical sliding surface of the grounding-side conductor 203*b* becomes significantly great. Therefore, there was a problem in that an operating device having a large drive output to operate the operating shaft 204 is necessary, causing the entire GIS to become large. Furthermore, there was also a problem in that due to the friction between the moving contacts 207*a*, 207*b* and the cylindrical sliding surfaces of the conductors 203*a*, 203*b*, respectively, foreign objects that affect insulation characteristics could easily be produced. Herein, in FIG. 6, components that correspond to the same portions in FIG. 5 are numbered in the 200s, and their description will be omitted.

A structure in which an open angle between the disconnecting switch-side conductor and the grounding-side conductor is nearly a right angle has been realized, for example, in a 3-position switch described in the publication of examined applications No. Showa 54(1979)-29701 (patent literature 1). Patent literature 1 discloses a 3-position switch including a cam having a nearly V-shaped cam groove provided between central conductors, and a disconnecting switch-side moving contact and an earthing switch-side moving contact that move in the cam groove by means of rollers.

This structure makes it possible to reduce the length of the tank by making the open angle between the disconnecting switch-side conductor and the grounding-side conductor nearly a right angle. However, there was a problem in that sliding powder was generated as the result of the rollers sliding on the cam groove. Furthermore, another problem was that the structure was too complicated and it took time to produce.

Next, a load force generated by driving a 3-position switch shown in FIG. 6 will be described with reference to the enlarged views of the switch portion and the vector diagrams shown in FIG. 7 through FIG. 9. FIG. 7(B) is a vector diagram in which an initial motion torque is given counterclockwise to the operating shaft 204 in the grounding state where the earthing switch-side moving contact 207*b* has been entered into the earthing switch-side fixed contact 210*b* as shown in FIG. 7(A).

Herein, a force component and a reaction force on the disconnecting switch portion 209*a* side will be discussed. In FIG. 7(B), when an initial drive torque is given, drive force $F_0$ is generated at the position of the rotation pin 211*c* of the single-hole lever 205. Next, force component $F_{11}$ of the drive force $F_0$ is generated, and force component $F_{12}$ indicated by $F_{11}$ Cos $\theta_2$ and force component $F_{13}$ indicated by $F_{11}$ Sin $\theta_2$ are further generated. Herein, $\theta_2$ is an angle formed by the center line of the disconnecting switch-side moving contact 207*a* and the line connecting rotation pins 211*a* and 211*c*.

It is preferable that the force component $F_{12}$ be large because it becomes an effective propulsion force in the direction of the axis of the moving contact 207*a*. However, the problem is the force component $F_{13}$ that is generated in the direction perpendicular to the axis of the moving contact 207*a*. Due to the force component $F_{13}$, the moving contact 207*a* is subject to reaction force $F_{14}$ and reaction force $F_{15}$ from the sliding surface of the disconnecting switch-side conductor 203*a*.

On the other hand, on the earthing switch portion 209*b* side, since the earthing switch-side moving contact 207*b* behaves in an opposite manner from the disconnecting switch portion 209*a*, force component $F_{21}$ is generated from drive force $F_0$; then, force component $F_{22}$ indicated by $F_{21}\text{Cos}\theta_1$ and force component $F_{23}$ indicated by $F_{21}\text{Sin}_1$ are generated.

Herein, $\theta_1$ is an angle formed by the center line of the earthing switch-side moving contact 207*b* and the line connecting rotation pins 211*b* and 211*c*.

It is preferable that the force component $F_{22}$ be large because it becomes an effective propulsion force in the direction of the axis of the earthing switch-side moving contact 207*b*. However, the problem is the force component $F_{23}$ that is generated in the direction perpendicular to the axis of the earthing switch-side moving contact 207*b* as previously stated. Due to the force component $F_{23}$, the earthing switch-side moving contact 207*b* is subject to reaction force $F_{24}$ and reaction force $F_{25}$ from the sliding surface of the earthing switch-side conductor 203*b*.

Next, the disconnecting state shown in FIGS. 8(A) and 8(B) will be described. When comparing angles $\theta_1$ and $\theta_2$ in this state with angles $\theta_1$ and $\theta_2$ in FIG. 7(B), angles shown in FIG. 8(B) are smaller. The angles $\theta_1$ and $\theta_2$ being small means that the sliding frictional force is small. This is because the sliding frictional force is a function of angles $\theta_1$ and $\theta_2$.

Next, the closed state shown in FIGS. 9(A) and 9(B) will be described. When comparing angles $\theta_1$ and $\theta_2$ in this state shown in FIG. 9(B) with angles $\theta_1$ and $\theta_2$ in FIG. 7(B), angle $\theta_1$ in FIG. 9(B) is the same as angle $\theta_2$ in FIG. 7(B), and angle $\theta_2$ in FIG. 9(B) is the same as angle $\theta_1$ in FIG. 7(B). This is because this link mechanism has an axisymmetric structure with respect to the bisector of the angle formed by the disconnecting switch-side conductor 203*a* and the grounding-side conductor 203*b*. Therefore, the reaction force that the disconnecting switch-side moving contact 207*a* receives from the sliding surface of the disconnecting switch-side conductor 203*a* is equivalent to the reaction force shown in FIG. 7(B).

The sliding frictional force is the product of reaction forces $F_{14}$, $F_{15}$, and $F_{24}$, $F_{25}$ that moving contacts 207*a*, 207*b* receive, respectively, and the contact friction coefficient of the cylindrical inner surface of the disconnecting switch-side conductor 203*a* and the cylindrical inner surface of the earthing switch-side conductor 203*b*, respectively. Since angles $\theta_1$, $\theta_2$ shown in FIG. 7 through FIG. 9 change according to the rotation position of the single-hole lever 205, the reaction forces $F_{14}$, $F_{15}$, $F_{24}$, $F_{25}$ also change according to the rotation position of the single-hole lever 205. The above study indicates that the angles $\theta_1$, $\theta_2$ are largest at the initial motion of each moving contact and at the completion of the operation; accordingly, the sliding frictional force also becomes largest at the initial motion of each moving contact and at the completion of the operation.

Hereinafter, based on FIGS. 10(A), (B), and (C), the relationship between the operation of each moving contact 207*a*, 207*b* and a load torque will be described. FIG. 10 shows the change of load torque Tb due to a sliding frictional force when a constant drive torque Ta is provided by an operating device. Let the friction coefficient between moving contacts 207*a*, 207*b* and the cylindrical sliding surface of the disconnecting switch-side conductor 203*a* and the cylindrical sliding surface of the earthing switch-side conductor 203*b*, respectively, be 1.2.

This load torque Tb curve shows the change of load torque when the 3-position switch starts operating from the grounding state. Load torque Tb in FIG. 10(A) shows only a load torque on the disconnecting switch portion 209*a* side. When drive torque Ta of the operating device is 100%, load torque Tb at the initial motion is 93.5%. As the disconnecting switch-side moving contact 207*a* moves in the closed-circuit direction, which is the direction of the disconnecting switch-side fixed contact 210*a*, load torque Tb rapidly decreases; and when angle $\theta_2$ shown in FIG. 3 through FIG. 5 is at the zero point, force component $F_{13}$ becomes zero. Although load torque Tb tends to increase after angle $\theta_2$ passes the zero point, the torque is obviously much smaller than the load torque at the initial motion.

FIG. 10(B) shows only a load torque on the earthing switch portion 209*b* side when the same operation shown in FIG. 10(A) is conducted. The load torque curve in FIG. 10(B) is completely opposite from that in FIG. 10(A). FIG. 10(B) indicates that when drive torque Ta of the operating device is 100%, the load torque only on the earthing switch portion 209*b* side is 93.5% immediately before the operation is completed.

When the, operating shaft 204 rotates, both the load torque of the disconnecting switch portion 209*a* and the load torque of the earthing switch portion 209*b* are simultaneously applied to the operating shaft 204. Load torque Tb plotted in FIG. 10(C) is the sum of the load torques in FIG. 10(A) and FIG. 10(B) that have been arithmetically calculated. At the initial motion of the 3-position switch, that is, when the stroke of each moving contact 207, 207*b* is 0% (immediately after operation has started from the grounding state), load torque Tb is 99.7% with respect to drive torque Ta of 100%. As the stroke of the disconnecting switch-side moving contact 207*a* increases, load torque Tb decreases. However, during 40% to 60% of the stroke, load torque Tb stops decreasing and starts to increase; and when the stroke is 100% (immediately before the closed state), load torque Tb reaches 99.7%.

As the above study indicates, an extremely large load torque occurs in the conventional 3-position switch shown in FIG. 6 at the initial motion and at the completion of the operation. Therefore, the conventional 3-position switch with a single-hole lever shown in FIG. 6 must use an operating device having a large operation force, which resulted in a problem that the size of the operating device increases.

An objective of a 3-position switch according to the present invention is to prevent the generation of foreign objects by maximally suppressing a sliding frictional force between the moving contact and the hollow conductor while adopting a simple mechanism to rectilinearly move both the moving contact of the disconnection portion and the moving contact of the earthing switch portion in an interlocking manner, thereby reducing the size of the entire apparatus including an operating device.

DISCLOSURE OF INVENTION

A disconnecting switch with earthing switch is structured such that a sealed tank, two main circuit conductors disposed in the sealed tank so that extended axes thereof intersect with each other. And, the disconnecting switch with earthing switch includes a disconnecting switch being disposed on one main circuit conductor side. The disconnecting switch has a disconnecting switch-side fixed contact and a disconnecting switch-side moving contact that linearly reciprocates in a hollow disconnecting switch-side conductor. And, the disconnecting switch with earthing switch includes an earthing switch being disposed between the other main circuit conductor and the sealed tank. The earthing switch has an earthing switch-side fixed contact and an earthing switch-side moving contact that linearly reciprocates in the hollow earthing switch-side conductor. And, the disconnecting switch with earthing switch includes an operating shaft allowing the disconnecting switch-side moving contact and earthing switch-side moving contact linearly reciprocates with the rotation thereof. The operating shaft is disposed on the bisector of an open angle of substantially a right angle formed by axes of the disconnecting switch-side conductor and the earthing switch-side conductor. And, the disconnecting switch with earthing switch includes a two-hole lever connected to the operating shaft to allow an arc motion and two curved links. Each one end thereof is connected to the two-hole lever and the other end thereof is respectively connected to a disconnecting switch-side moving contact or an earthing switch-side moving contact. And, when two connecting points where the disconnecting switch-side moving contact and the two-hole lever are connected to the disconnecting switch-side curved link and two connecting points where the earthing switch-side moving contact and the two-hole lever are connected to the earthing switch-side curved link are axisymmetric with respect to the bisector, both the disconnecting switch and the earthing switch are in an open state. And, when the two-hole lever moves at a predetermined angle from the open state to the disconnecting switch-side, the disconnecting switch is in a closed state. And, when the two-hole lever moves at a predetermined angle from the open state to the earthing switch-side, the earthing switch is in a closed state.

It is preferable that a sliding friction reducing member be disposed on the each inner circumferential surface of the disconnecting switch-side conductor and the earthing switch-side conductor on which the disconnecting switch-side moving contact and earthing switch-side moving contact slide.

Herein, in the present invention, the "curved link" that connects the disconnecting switch-side and earthing switch-side moving contacts to the two-hole lever is not limited to the arc-like curved link, but it widely includes links of any shape having a predetermined angle, such as a right-angle link and the like. Furthermore, the outer shape of the "two-hole lever" in the present invention is not particularly limited as long as the two-hole lever allows arc motion around the operating shaft and can connect two curved links, which enable moving contacts linearly reciprocates, at two locations on the end portion opposite from the operating shaft.

Advantages of the Invention

A 3-position switch according to the present invention is structured such that when a disconnecting switch-side and earthing switch-side moving contacts slide in a hollow disconnecting switch-side conductor and a hollow earthing switch-side conductor, respectively, each moving contact is linearly reciprocated by a two-hole lever via a curved link. This structure enables the reduction of the frictional force generated when a conventional single-hole lever is used as well as generated specifically at the initial motion. Furthermore, reduction of the frictional force leads to the decrease in the size of the operating device, which makes it possible to reduce the size of the entire apparatus.

Furthermore, since a curved link is directly connected to the two-hole lever to form a link mechanism portion, a complicated structure like conventional apparatuses is not necessary and a simple structure becomes possible. Such a simple structure enables the reduction of burden imposed when 3-position switches are manufactured. Furthermore, it is possible to reduce the generation of foreign objects including sliding powder coming from the link mechanism portion, thereby increasing reliability of the apparatus.

Furthermore, by mounting a sliding friction reducing member onto the inner circumferential surface of both the hollow disconnecting switch-side conductor and the hollow earthing switch-side conductor, it is possible to further reduce sliding friction that occurs when each moving contact travels.

BEST MODE FOR CARRYING OUT THE INVENTION

Hereinafter, an embodiment of the present invention will be described with reference to the drawings. Herein, the embodiment below is an example of a 3-position switch according to the present invention, and it is possible to properly change the shape of each portion and the structure within the range that does not depart from the concept of the present invention.

[Embodiment 1]

Figure 1A:
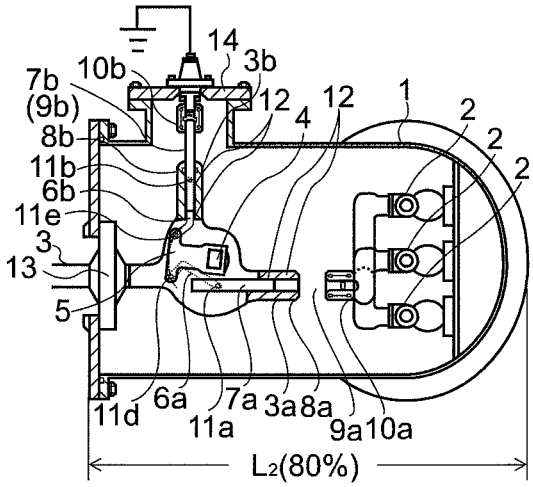
FIGS. 1(A), 1(B), 1(C) are cross-sectional views showing the structure and operation of a 3-position switch according to an embodiment of the present invention.
Figure 1B:
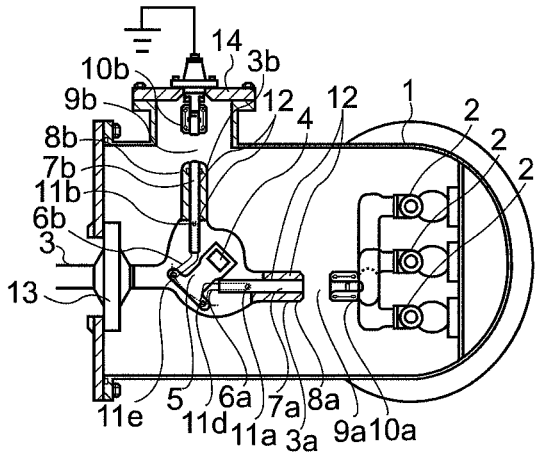
Figure 1C:
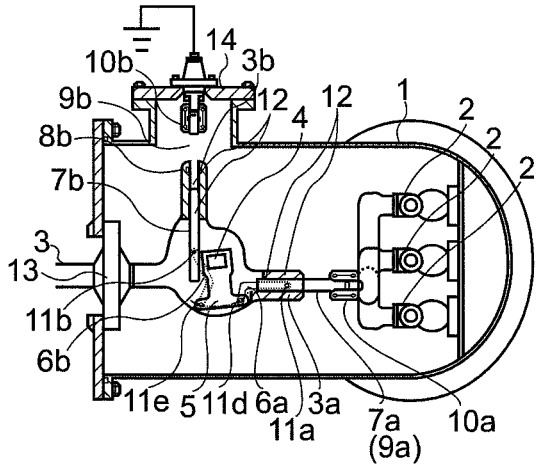

An embodiment of a 3-position switch according to the present invention is shown in FIGS. 1(A) through 1(C). In FIG. 1(A), the disconnecting switch portion 9*a* is in the open state and the earthing switch portion 9*b* is in the closed state. This state is hereafter referred to as a "grounding state". In FIG. 1(B), both the disconnecting switch portion 9*a* and the earthing switch portion 9*b* are in the open state. This state is hereafter referred to as a "disconnecting state". In FIG. 1(C), the disconnecting switch portion 9*a* is in the closed state and the earthing switch portion 9*b* is in the open state. This state is hereafter referred to as a "closed state".

A three-phase main circuit conductor 2 is disposed in a gas-insulated sealed tank 1 so that the conductor extends in the direction shown in the drawing. This main circuit conductor 2 is provided with a disconnecting switch-side fixed contact 10*a* and is electrically connected to the contact. The main circuit conductor 2 of the other phase is also provided with a disconnecting switch-side fixed contact, not shown, and is electrically connected to the contact. Furthermore, at the end portion opposite from the main circuit conductor 2 in the sealed tank 1, a main circuit conductor 3 is disposed and supported by an insulating spacer 13 so that the central axes of the main circuit conductors 2 and 3 intersect with each other. On the upper part of the sealed tank 1, an earthing switch-side fixed contact 10*b* is screwed to the flange lid 14.

And, as is conventionally done, on one main circuit conductor 2 side, there is provided a disconnecting switch including a disconnecting switch-side fixed contact 10*a* and a disconnecting switch-side moving contact 7*a* that linearly reciprocates in the disconnecting switch-side conductor 3*a*. Also in the same manner, between the other main circuit conductor 3 and the sealed tank 1, there is provided an earthing switch including an earthing switch-side fixed contact 10*b* and an earthing switch-side moving contact 7*b* that linearly reciprocates in the earthing switch-side conductor 3*b*.

Figure 2A:
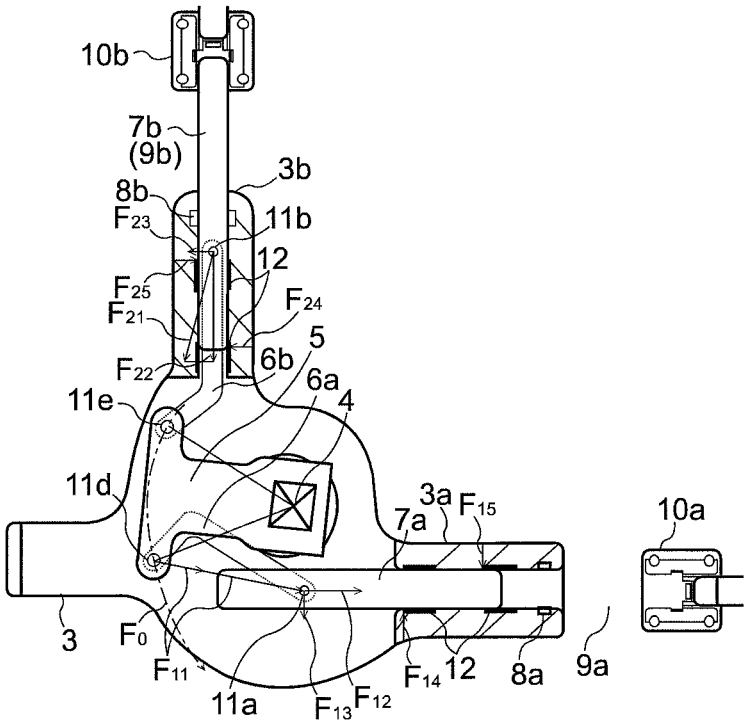
FIG. 2(A) is an enlarged view of the switch portion in FIG. 1(A)

FIG. 2(A) is an enlarged view of the switch portion in FIG. 1(A), wherein the disconnecting switch portion 9*a* is disposed so that the disconnecting switch-side fixed contact 10*a* and the disconnecting switch-side moving contact 7*a* are opposed to each other. The disconnecting switch-side moving contact 7*a* is slidably held by a hollow disconnecting switch-side conductor 3*a* so that it can linearly reciprocate. The disconnecting switch-side conductor 3*a* is provided with a collector 8*a* therein and is electrically connected to the disconnecting switch-side moving contact 7*a* via the collector 8*a* and is electrified.

The earthing switch-side fixed contact 10*b* of the earthing switch portion 9*b* is for grounding the main circuit conductor 3, and the contact for three phases is disposed so that it is opposed to the earthing switch-side moving contact 7*b*. The grounding-side conductor 3*b* is also hollow as is the disconnecting switch-side conductor 3*a*, and slidably supports the earthing switch-side moving contact 7*b* inside so that the moving contact can linearly reciprocate. Furthermore, the grounding-side conductor 3*b* is provided with a collector 8*b* therein and is electrically connected to the earthing switch-side moving contact 7*b* via the collector 8*b* and is electrified. The angle formed by the center lines of the disconnecting switch-side conductor 3*a* and the grounding-side conductor 3*b* is 90 degrees so the center lines intersect with each other.

Next, the structure of a two-hole lever 5 fixed to the operating shaft 4 which is a characteristic of the present invention will be described with reference to FIG. 2 through FIG. 4. As shown in FIG. 2 through FIG. 4, one end of the two-hole lever 5 is fixed to the operating shaft 4 so as to enable an arc motion indicated by the dashed-dotted line. The two-hole lever is provided for each phase, and each lever is fixed to the operating shaft 4 to be mechanically united. As the operating shaft 4 rotates, the two-hole lever for each phase also allows the arc motion by interlinking with the operating shaft 4. The operating shaft 4 is located on the bisector of the angle formed by the axes of the disconnecting switch-side conductor 3*a* and the grounding-side conductor 3*b*.

The two-hole lever 5 is connected to the ends of the curved links 6*a* and 6*b* by means of rotation pins 11*d* and 11*e*, respectively. The other ends of the curved links 6*a* and 6*b* are connected to the disconnecting switch-side moving contact 7*a* and the earthing switch-side moving contact 7*b* by rotation pins 11*a* and 11*b*, respectively. Material for the curved links 6*a* and 6*b* is not limited as long as the material is strong enough to withstand the frictional force that occurs when each moving contact 7*a*, 7*b* slides on the inner circumferential surface of each hollow conductor 3*a*, 3*b*.

Figure 3A:
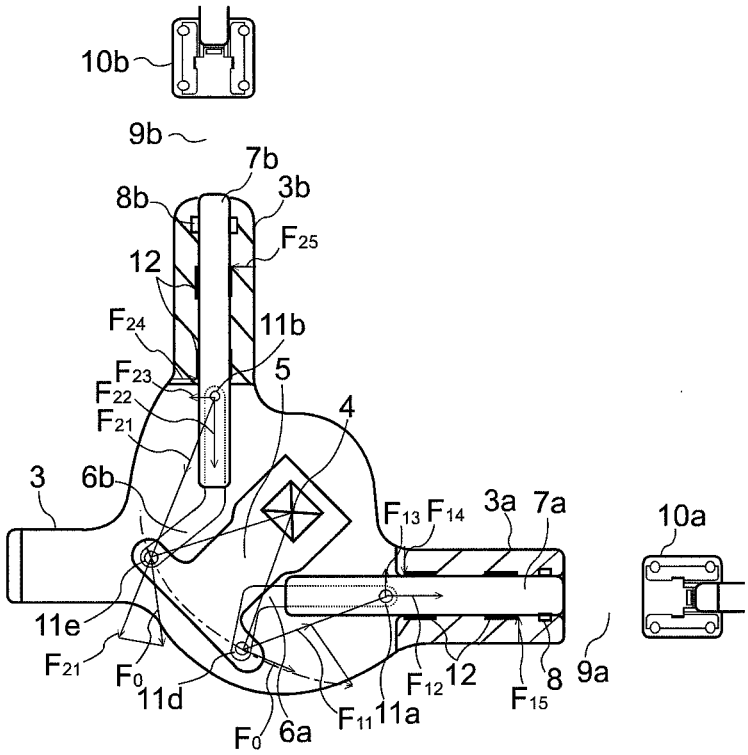
FIG. 3(A) is an enlarged view of the switch portion in FIG. 1(B)
Figure 4A:
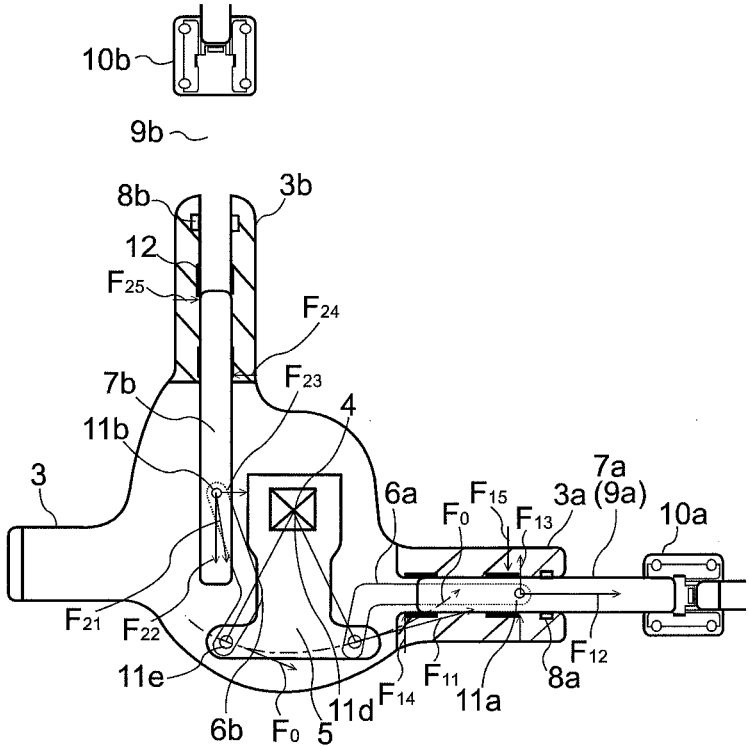
FIG. 4(A) is an enlarged view of the switch portion in FIG. 1(C)

In FIG. 3(A), with respect to the bisector of an angle formed by the center lines of the disconnecting switch-side conductor 3*a* and the grounding-side conductor 3*b*, the earthing switch portion 9*b* side rotation pins 11*b* and 11*e* and the disconnecting switch portion 9*a* side rotation pins 11*a* and 11*d* are symmetric.

In this state, the earthing switch portion 9*b* side curved link 6*b* curves to the left at approximately one third of the entire length of the link measuring from the rotation pin 11*e* side end portion so that the rotation pin lie side end portion can separate from the operating shaft 4 on the axis line of the earthing switch-side moving contact 7*b*. In the same manner, the disconnecting switch portion 9*a* side curved link 6*a* curves to the bottom at approximately one third of the entire length of the link measuring from the rotation pin 11*d* side end portion so that the rotation pin 11*d* side end portion can separate from the operating shaft 4 on the axis line of the movable member 7*a*.

In FIG. 3(A), positions of rotation pins 11*a* and 11*b* that connect curved links 6*a* and 6*b* to moving contacts 7*a* and 7*b*, respectively, are located near the operating shaft 4 side end portion of the disconnecting switch-side conductor 3*a* and the grounding-side conductor 3*b*, respectively. However, positions of rotation pins 11*a* and 11*b* with respect to the disconnecting switch-side conductor 3*a* and the grounding-side conductor 3*b* are not particularly limited as long as the curved portions of the curved links 6*a* and 6*b* do not interfere with the sliding operation of the moving contacts 7*a* and 7*b* on the inner surface of the disconnecting switch-side conductor 3*a* and the grounding-side conductor 3*b*, respectively.

In the grounding state shown in FIG. 2(A), the curved link 6*b* of the 3-position switch according to this embodiment has a curved portion which is structured such that the rotation pin lie disposed at one end of the curved link is located on the opposite side of the operating shaft 4 with respect to the axis line of the earthing switch-side moving contact 7*b*. On the other hand, in the closed state shown in FIG. 4(A), the curved link 6*a* has a curved portion which is structured such that the rotation pin lid disposed at one end of the curved link is located on the opposite side of the operating shaft 4 with respect to the axis line of the disconnecting switch-side moving contact 7*a*.

Figure 5:
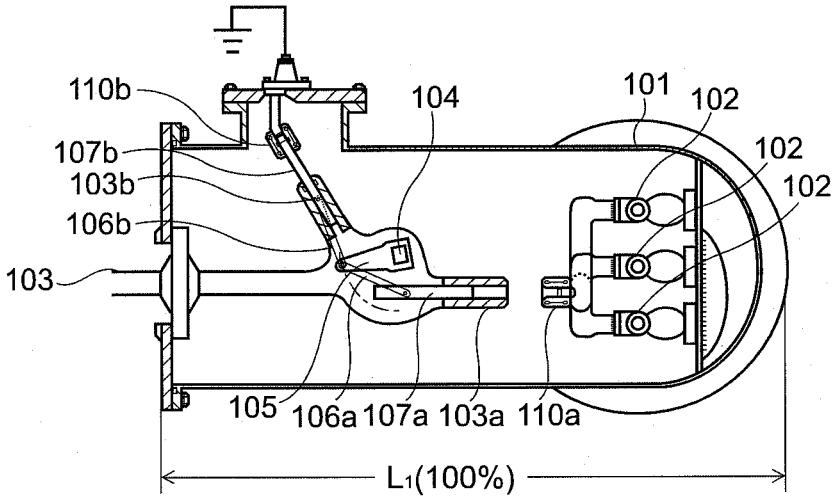
FIG. 5 is a cross-sectional view showing the structure of a conventional 3-position switch.

As the two-hole lever 5 rotates, the link that connects each moving contact 7*a*, 7*b* to the two-hole lever 5 allows the arc motion around the point where each moving contact is connected. Therefore, when a rectilinear link is used as that link, it is necessary to provide a space that enables the arc motion between the rectilinear link and a hollow conductor. In the grounding state of the structure of the conventional example using a rectilinear link shown in FIG. 5 and FIG. 6, it is necessary to form a groove on the left side of the inner circumferential surface of the grounding-side conductor 103*b*; and in the closed state, it is necessary to form a groove on the bottom side of the inner circumferential surface of the disconnecting switch-side conductor 103*a*. Also in this embodiment, if a rectilinear link is used, a similar groove must be formed on the inner circumferential surface of each hollow conductor (the surface of each hollow conductor on which the rectilinear link slides).

However, in this embodiment, the use of two curved links 6*a* and 6*b* makes it possible to suppress the effect of the arc motion on the hollow disconnecting switch-side conductor 3*a* and the hollow grounding-side conductor 3*b*. Therefore, moving contacts 7*a* and 7*b* can linearly reciprocate in the disconnecting switch-side conductor 3*a* and the grounding-side conductor 3*b*, respectively, without making a groove in the end portion of the sliding surface of the disconnecting switch-side conductor 3*a* and the grounding-side conductor 3*b*. Since it is not necessary to make a groove in the sliding surface of the hollow disconnecting switch-side conductor 3*a* and the hollow grounding-side conductor 3*b*, the sliding friction reducing member 12, described below, can be easily mounted to the inner circumferential surface of the hollow conductors 3*a* and 3*b*. Consequently, the sliding friction can be further reduced.

In this embodiment, sliding friction reducing materials 12 are circumferentially mounted at two locations onto the inner circumferential surface of the hollow disconnecting switch-side conductor 3*a* and the inner circumferential surface of the hollow grounding-side conductor 3*b* at predetermined intervals. It is possible to significantly reduce the load torque of sliding friction by each moving contact 7*a*, 7*b* sliding on the sliding friction reducing material 12. This sliding friction reducing material 12 can be disposed in a continuous circle or can be positioned at predetermined intervals.

The number of disposed sliding friction reducing materials 12 and intervals are not intended to be limited to those in this embodiment and can be adjusted flexibly. As described later, when the sliding friction reducing materials 12 are disposed at two locations, by making the interval between the two locations as large as possible, friction on the sliding surface can be reduced. As a sliding friction reducing material 12, for example, a wear resistant material, such as tetrafluoroethylene resin or the like, with a filling included is suitable.

Hereafter, operation of the 3-position switch according to this embodiment and associated electrical current flow will be described with reference to FIGS. 1(A), 1(B), 1(C). In the grounding state shown in FIG. 1(A), the earthing switch-side fixed contact 10*b* is always grounded and its potential is equivalent to that of the ground. When the earthing switch-side moving contact 7*b* contacts the earthing switch-side fixed contact 10*b*, electricity runs via a collector 8*b* from the main circuit conductor 3 via the earthing switch-side moving contact 7*b* to the earthing switch-side fixed contact 10*b*. On the other hand, the disconnecting switch-side moving contact 7*a* is located in the cylinder of the disconnecting switch-side conductor 3*a*, and the disconnecting switch portion 9*a* is electrically disconnected.

FIG. 1(B) shows the disconnecting state wherein the operating shaft 4 is rotated counterclockwise from the grounding state in FIG. 1(A) by half of the movable rotation angle. In this state, each switch portion is gas-insulated and has a predetermined insulation strength. This state is to electrically neutralize both switch portions before conducting the next opening and closing operations so as to ensure safety.

FIG. 1(C) shows the closed state wherein the operating shaft 4 is rotated counterclockwise from the disconnecting state in FIG. 1(B) by the remaining half of the movable rotation angle. The earthing switch portion 9*b* remains completely in the electrical open state at the position shown in FIG. 1(B), and the switch portion 9*a* of the disconnecting switch is in the complete closed state.

Figure 6:
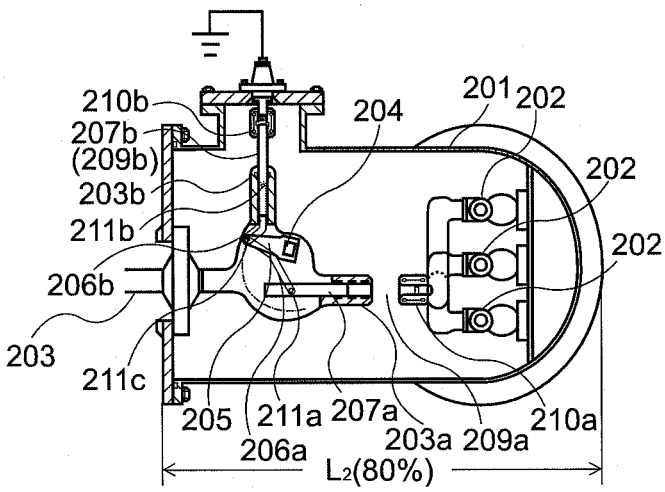
FIG. 6 is a cross-sectional view showing the structure of another conventional 3-position switch.

Next, with reference to the drawings, a description will be given about how the load torque generated when a two-hole lever of the 3-position switch according to this embodiment is used and can be reduced when compared with the load torque generated when a conventional single-hole lever is used as shown in FIG. 6.

Figure 2B:
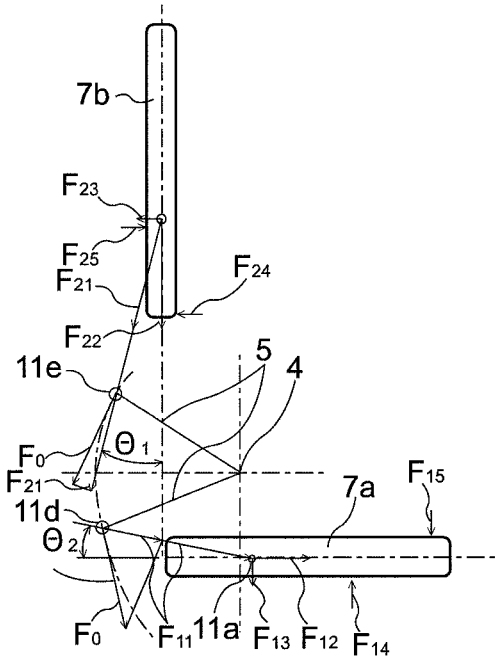
FIG. 2(B) is a vector diagram showing the drive force and the load force immediately after the earthing switch started to operate from the closed state.

Hereafter, with reference to FIG. 2 through FIG. 4, how the 3-position switch of this embodiment can reduce load torque will be described. FIG. 2(B) is a vector diagram in which an initial motion torque is given counterclockwise to the operating shaft 4 in the grounding state in FIG. 2(A). In FIG. 2(B), when a drive torque is applied to the operating shaft 4, drive force $F_0$ is generated on the rotation pin 11*d*, resulting in the generation of force component $F_{11}$ of the drive force $F_0$. Subsequently, from the force component $F_{11}$, force component $F_{12}$ that becomes a propulsion force for the disconnecting switch-side moving contact 7*a* and force component $F_{13}$ perpendicular to the axis of the moving contact are generated.

The force component $F_{13}$ becomes the factor that generates a sliding frictional force between the disconnecting switch-side moving contact 7*a* and the cylindrical inner surface of the disconnecting switch-side conductor 3*a*. This means that the generation of the force component $F_{13}$ generates reaction forces indicated by force component $F_{14}$ and force component $F_{15}$ at the support point to which the sliding friction reducing material 12 is mounted. The value of the frictional force can be obtained by multiplying force component $F_{14}$ or force component $F_{15}$ by the friction coefficient.

Figure 7A:
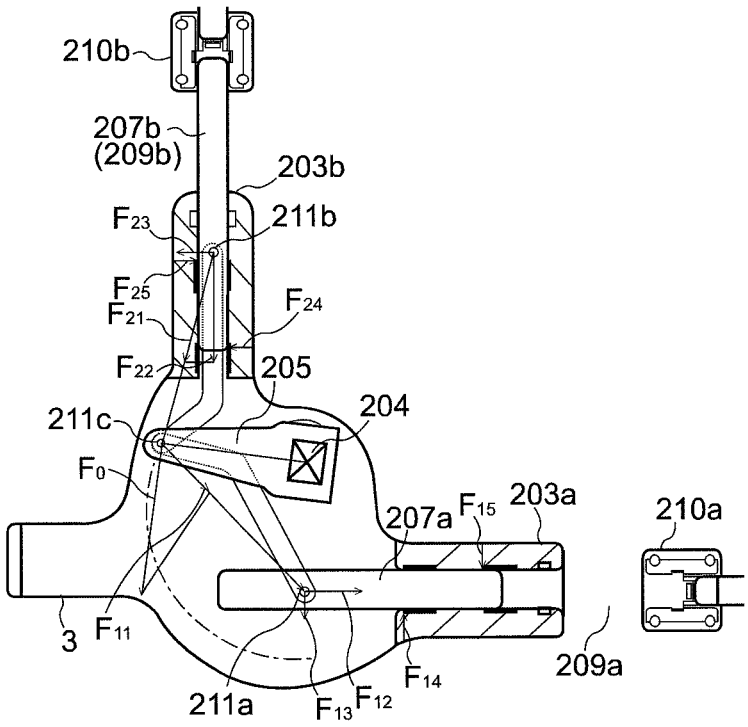
FIG. 7(A) is an enlarged view of the switch portion in FIG. 6.
Figure 7B:
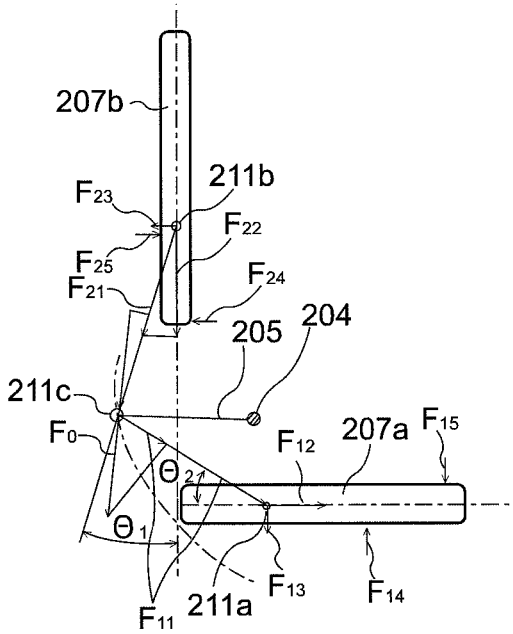
FIG. 7(B) is a vector diagram showing the drive force and the load force immediately after the earthing switch started to operate from the closed state.
Figure 8A:
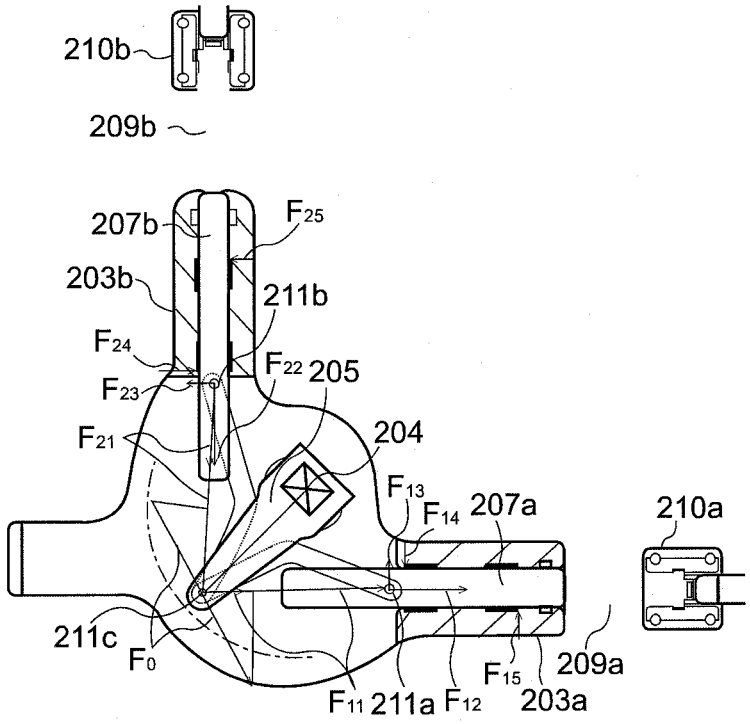
FIG. 8(A) is an enlarged view of the switch portion in FIG. 6.
Figure 8B:
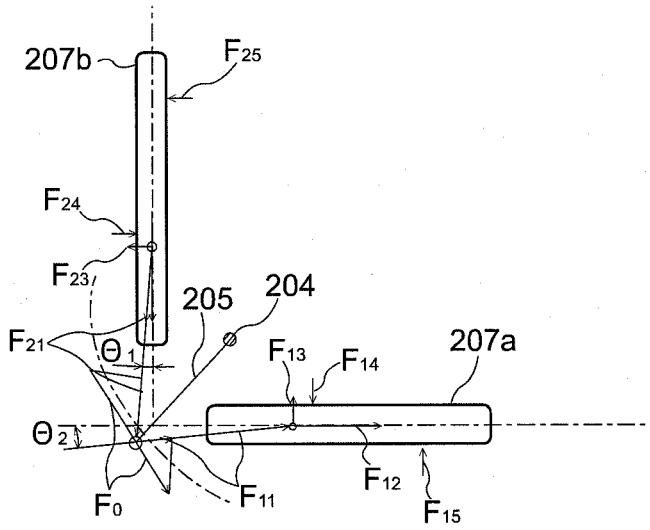
FIG. 8(B) is a vector diagram showing the drive force and the load force when the earthing switch is in the open state and the disconnecting switch is in the open state.
Figure 9A:
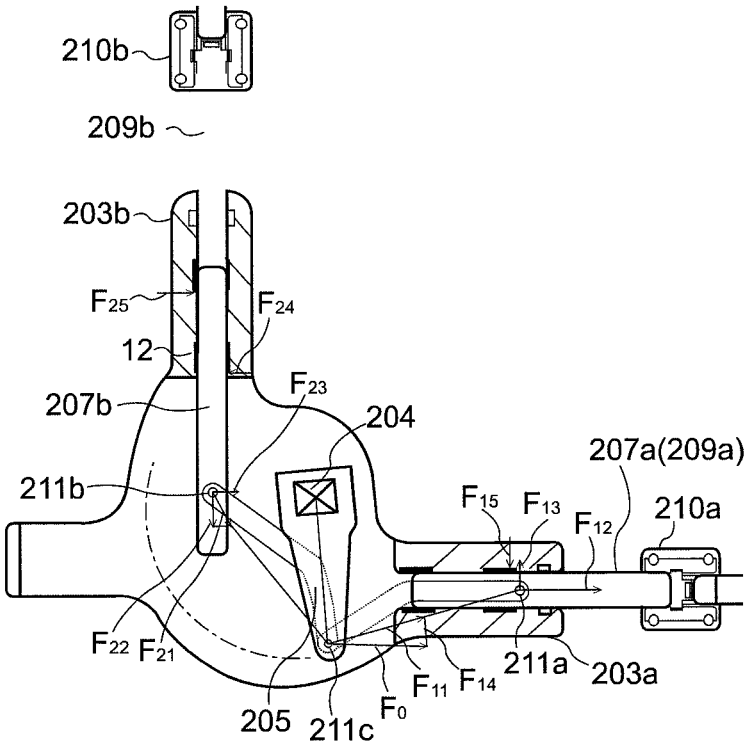
FIG. 9(A) is an enlarged view of the switch portion in FIG. 6.
Figure 9B:
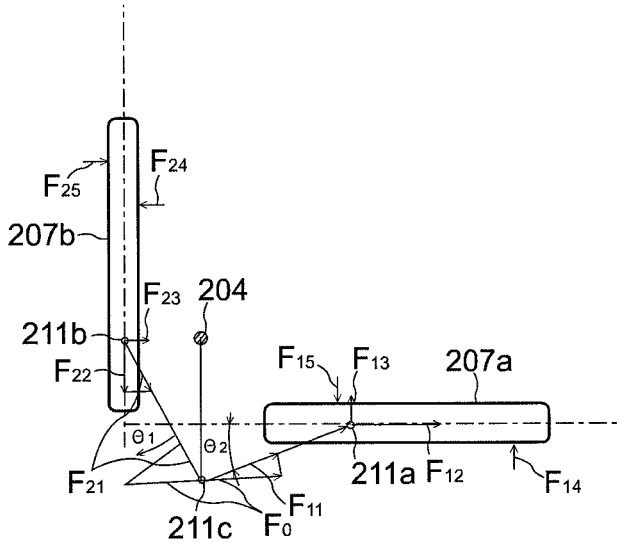
FIG. 9(B) is a vector diagram showing the drive force and the load force when the earthing switch is in the open state and the disconnecting switch is about to become in the closed state.

The force component $F_{13}$ is represented by $F_{11}$ Sin $\theta_2$. Therefore, the sliding frictional force is significantly affected by angle $\theta_2$. For this reason, this embodiment adopts the structure that enables the angle $\theta_2$ to be small. That is, two rotation pins 11*d* and 11*e* are provided for the two-hole lever 5, ends of the curved links 6*a* and 6*b* are connected to the two-hole lever 5 by means of rotation pins 11*d* and 11*e*, respectively, and the other ends of the curved links 6*a* and 6*b* are connected to the moving contacts 7*a* and 7*b*, respectively. As clearly indicated by the comparison between the present invention in FIG. 2(B) and the conventional apparatus in FIG. 7(B), the use of the two-hole lever 5 makes it possible to make the angle $\theta_2$ smaller than that in the conventional apparatus which uses a single-hole lever.

Furthermore, the sliding frictional force is affected by the distance between the working point of force component $F_{13}$ and the support point of reaction force sharing force component $F_{14}$ or $F_{15}$. This distance is maximized at the initial motion shown in FIG. 7 and then changes from hour to hour. This means that the sliding frictional force becomes a function having variables of continuously changing angle $\theta_2$ and the distance.

Figure 3B:
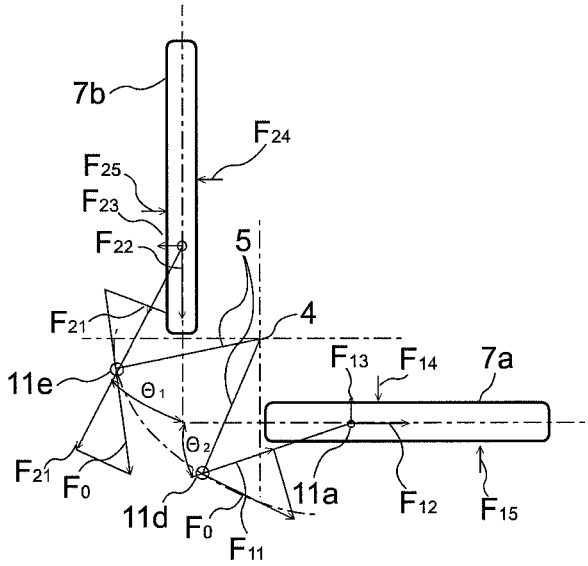
FIG. 3(B) is a vector diagram showing the drive force and the load force when the earthing switch is in the open state and the disconnecting switch is in the open state.

FIG. 3(B) shows the state of the vector when the operating shaft 4 is rotated counterclockwise from the state in FIG. 2(B) by half of the movable rotation angle. Angle $\theta_2$ in FIG. 3(B) is larger than angle $\theta_2$ in FIG. 2(B) at the absolute value. However, the distance between the working point of force component $F_{13}$ and the support point of reaction force sharing force component $F_{14}$ is smaller than the distance shown in FIG. 2(B). Thus, it is possible to make reaction force sharing force component $F_{14}$ and force component $F_{15}$ relatively small. Accordingly, by reducing the distance between the working point of force component $F_{13}$ and the support point of reaction force sharing force component $F_{14}$, it is possible to make the sliding frictional force that occurs in the disconnecting state smaller than the sliding frictional force that occurs at the initial motion shown in FIG. 2(B).

Figure 4B:
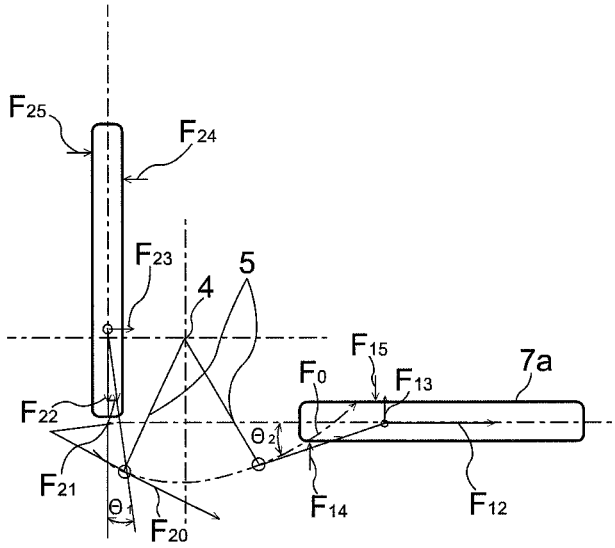
FIG. 4(B) is a vector diagram showing the drive force and the load force when the earthing switch is in the open state and the disconnecting switch is about to become in the closed state.

FIG. 4(B) shows the state of the vector when the operating shaft 4 is rotated counterclockwise from the open state in FIG. 3(B) by the remaining half of the movable rotation angle. By doing so, angle $\theta_2$ is equivalent to the angle $\theta_2$ shown in FIG. 2(B), and the distance between the working point of force component $F_{13}$ and the support point of reaction force sharing force component $F_{15}$ is smaller than the distance between the working point of force component $F_{13}$ and the support point of force component $F_{14}$ shown in FIG. 3(B). Thus, it is possible to make the sliding frictional force smaller than that in the open state shown in FIG. 3(B).

With regard to earthing switch-side force components $F_{21}$ to $F_{25}$ shown in FIG. 2(B), FIG. 3(B), and FIG. 4(B), it is possible to make the sliding frictional force small in the same manner as on the above-mentioned disconnecting switch side.

Figure 10A:
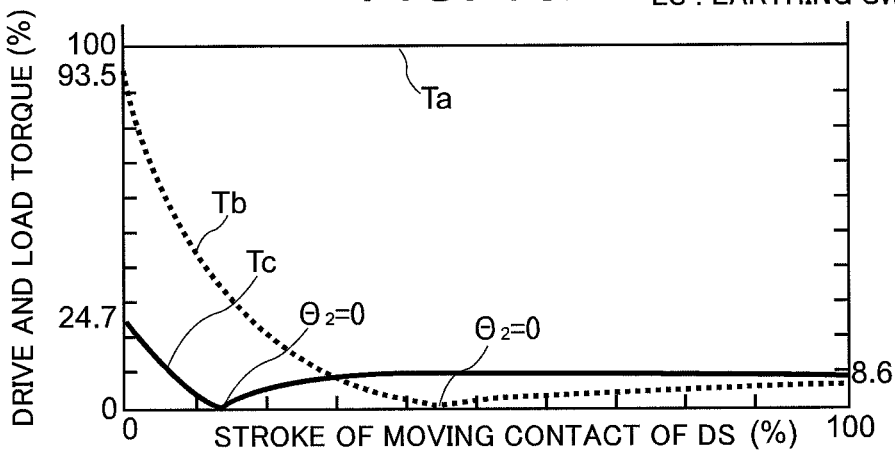
FIG. 10(A) is a characteristic diagram of the disconnecting switch-side load torque showing the relations among the moving contact stroke and a drive torque and a load torque when the sliding friction coefficient is 1.2.
Figure 10B:
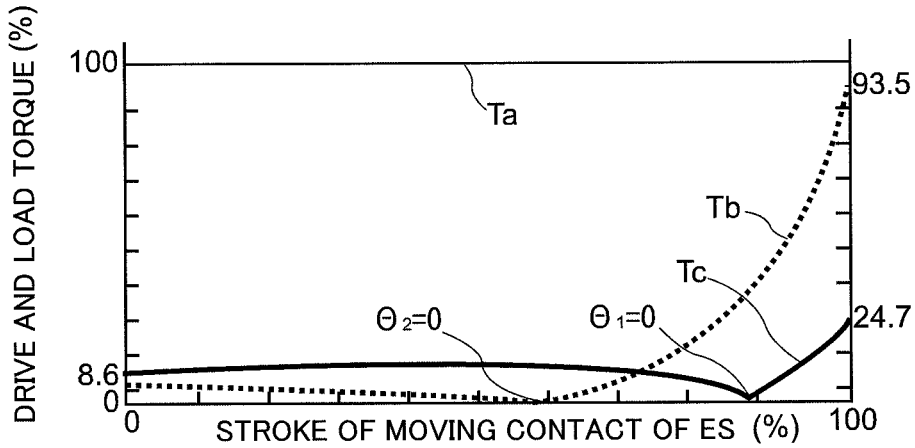
FIG. 10(B) is a characteristic diagram of the earthing switch-side load torque showing the relations among the moving contact stroke and a drive torque and a load torque when the sliding friction coefficient is 1.2.
Figure 10C:
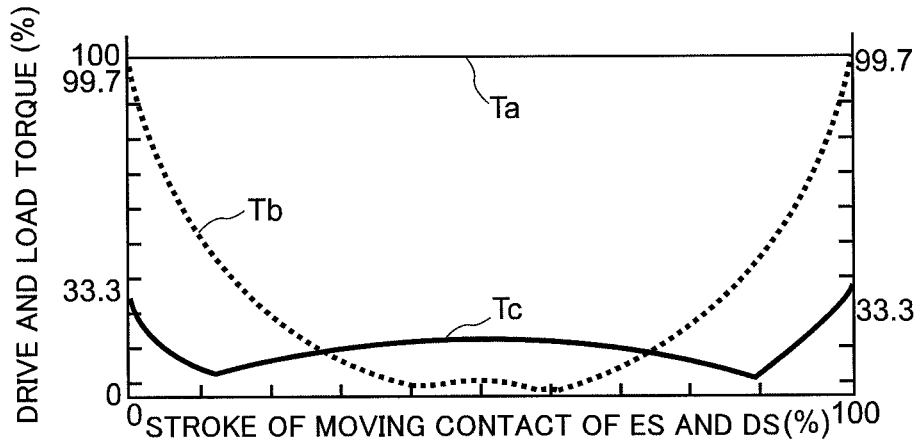
FIG. 10(C) is a characteristic diagram of the summed load torque obtained by adding together the load torque curves shown in FIG. 10(A) and FIG. 10(B).

As stated above, the sliding frictional force in three states shown in FIG. 2 through FIG. 4 was described individually. Next, those states will be described in terms of load torque. FIG. 10 through FIG. 12 show load torque Tc obtained by continuously calculating and arithmetically adding the sliding frictional force from the initial motion to the completion of the operation. The load torque Tc curves when a two-hole lever is used as shown in FIG. 10(A), 10(B), and 10(C) are the curves when the sliding friction coefficient is 1.2. In the drawings, the load torque curve of this embodiment is indicated by the solid line.

FIG. 10(A) shows the load torque curve of only the disconnecting switch. When a constant drive torque Ta (100%) is given, load torque Tc at the initial motion of the disconnecting switch according to the present invention is 24.7% with respect to drive torque Ta. On the other hand, when a single-hole lever 205 is used, load torque Tb at the initial motion shown in FIG. 3(A) is 93.5% with respect to drive torque Ta. Therefore, it is indicated that the adoption of the structure of this embodiment makes it possible to reduce load torque Tc by approximately 70% when compared with the previously-mentioned structure that uses a single-hole lever. Thus, drive output from the operating device can be reduced, and the size of the operating device can be reduced.

FIG. 10(B) shows the load torque curve of only the earthing switch. When a constant drive torque Ta (100%) is given, load torque Tc at the initial motion of the earthing switch according to the present invention is 8.6% with respect to drive torque Ta. Since structures of the earthing switch and the disconnecting switch are symmetric, the load torque Tc curve of the earthing switch shows the opposite characteristics from the load torque Tc curve of the disconnecting switch.

FIG. 10(C) shows the load torque Tc curve obtained by arithmetically adding load torque Tc of the disconnecting switch and load torque Tc of the earthing switch. Because load torque Tc of both the disconnecting switch and the earthing switch is simultaneously generated at the initial motion, load torque Tc at the initial motion is 33.3% with respect to constant drive torque Ta (100%). This means that the load torque Tc can be reduced to approximately 66.4% (=99.7−33.3) when compared with the load torque Tb of the operating device with a single-hole lever at the initial motion.

Figure 11A:
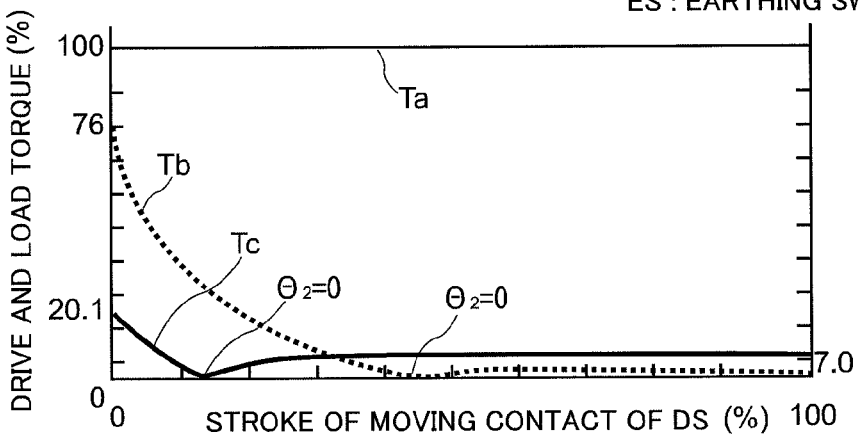
FIG. 11(A) is a characteristic diagram of the disconnecting switch-side load torque showing the relations among the moving contact stroke and a drive torque and a load torque when the sliding friction coefficient is 1.0.
Figure 11B:
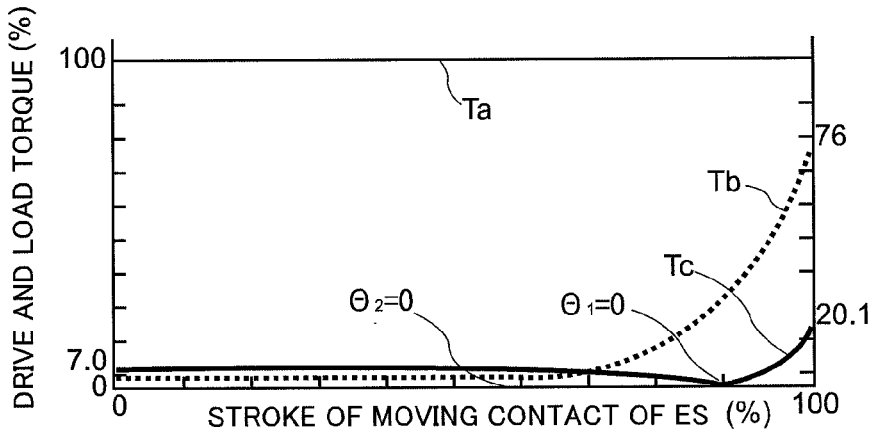
FIG. 11(B) is a characteristic diagram of the earthing switch-side load torque showing the relations among the moving contact stroke and a drive torque and a load torque when the sliding friction coefficient is 1.0.
Figure 11C:
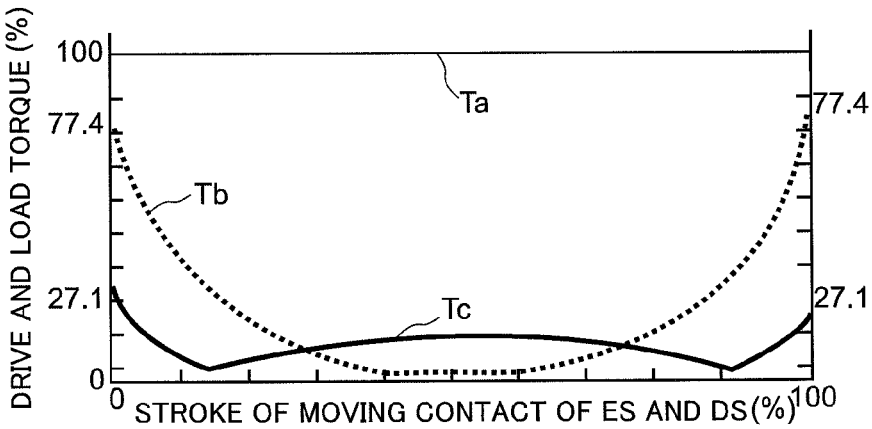
FIG. 11(C) is a characteristic diagram of the summed load torque obtained by adding together the load torque curves shown in FIG. 11(A) and FIG. 11(B).

Furthermore, the load torque curves shown in FIG. 11(A), 11(B), and 11(C) are the curves when the sliding friction coefficient is 1.0. The load torque Tc curve of this embodiment is indicated by the solid line. When compared with the load torque at the initial motion shown in FIG. 10(A), 10(B), and 10(C), as the sliding friction coefficient decreases, the load torque also decreases.

Figure 12A:
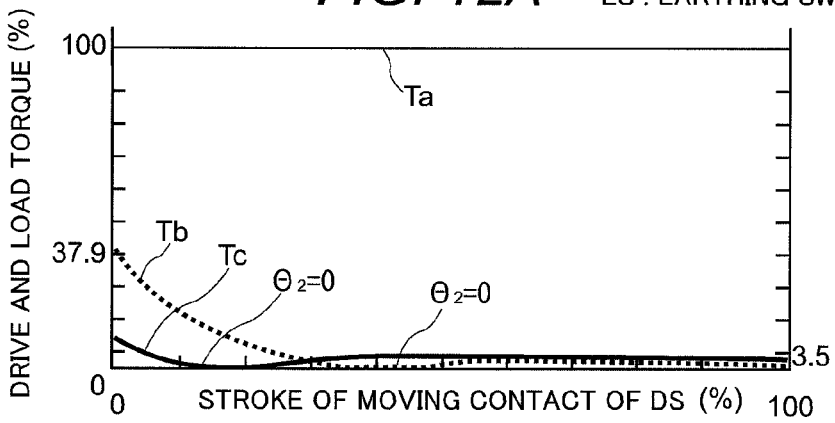
FIG. 12(A) is a characteristic diagram of the disconnecting switch-side load torque showing the relations among the moving contact stroke and a drive torque and a load torque when the sliding friction coefficient is 0.5.
Figure 12B:
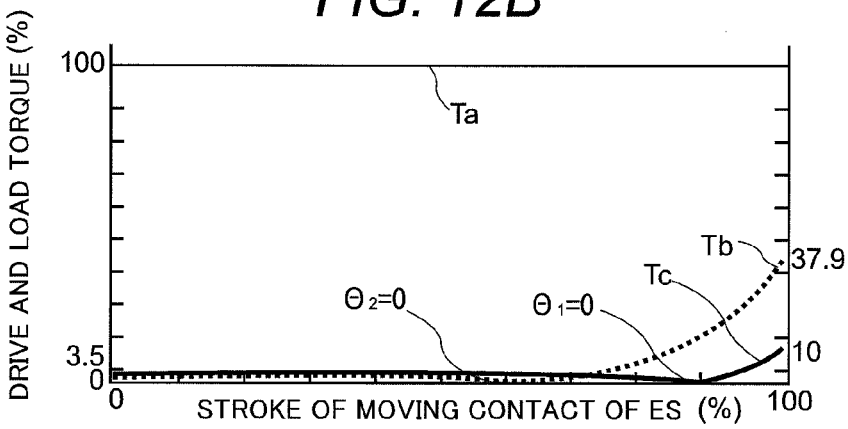
FIG. 12(B) is a characteristic diagram of the earthing switch-side load torque showing the relations among the moving contact stroke and a drive torque and a load torque when the sliding friction coefficient is 0.5.
Figure 12C:
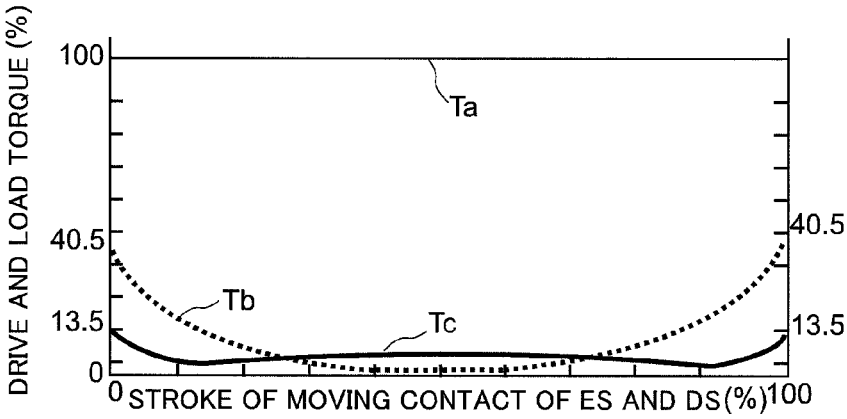
FIG. 12(C) is a characteristic diagram of the summed load torque obtained by adding together the load torque curves shown in FIG. 12(A) and FIG. 12(B).

Furthermore, the load torque curves shown in FIG. 12(A), 12(B), and 12(C) are the curves when the sliding friction coefficient is 0.5. The load torque Tc curve of this embodiment is indicated by the solid line. When compared with the load torque at the initial motion shown in FIG. 10(A), 10(B), 10(C), 11(A), 11(B), and 11(C), as the sliding friction coefficient decreases, the load torque further decreases.

As clearly indicated by FIG. 10 through FIG. 12, since the load torque changes due to the friction coefficient of the sliding friction reducing material 12, it is important to select appropriate material. Furthermore, it is preferable that the sliding friction reducing material 12 be mounted and demounted so that parts can be easily replaced when the sliding friction reducing member wears with age.

As stated above, the 3-position switch according to this embodiment can reduce the load torque of moving contacts at the initial motion while adopting a simple mechanism to interlock the moving contacts of the disconnecting portion and the earthing switch portion. Thus, an operating device with a small operating force can be used, enabling the reduction of the size of the entire apparatus. Furthermore, it is possible to dispose the moving contact of the disconnecting switch and the moving contact of the earthing switch at a right angle.

Consequently, the whole length of the tank can be reduced, and the size of the entire GIS that uses this apparatus can be reduced.

[Industrial Applicability]

A 3-position switch according to the present invention is significantly effective because it can be used for any type of GIS.

The invention claimed is:

1. A disconnecting switch with earthing switch comprising:

a sealed tank;

two main circuit conductors disposed in the sealed tank so that extended axes thereof intersect with each other;

a disconnecting switch being disposed on one main circuit conductor side, the disconnecting switch having a disconnecting switch-side fixed contact and a disconnecting switch-side moving contact that linearly reciprocates in a hollow disconnecting switch-side conductor;

an earthing switch being disposed between the other main circuit conductor and the sealed tank, the earthing switch having an earthing switch-side fixed contact and an earthing switch-side moving contact that linearly reciprocates in a hollow earthing switch-side conductor; and an operating shaft allowing the disconnecting switch-side moving contact and the earthing switch-side moving contact linearly reciprocates with the rotation thereof, the operating shaft being disposed on the bisector of an open angle of substantially a right angle formed by axes of the disconnecting switch-side conductor and the earthing switch-side conductor;

a two-hole lever connected to the operating shaft to allow an arc motion; and two curved links, each one end thereof is connected to the two-hole lever and the other end thereof is respectively connected to a disconnecting switch-side moving contact or an earthing switch-side moving contact, wherein when two connecting points where the disconnecting switch-side moving contact and the two-hole lever are connected to the disconnecting switch-side curved link and two connecting points where the earthing switch-side moving contact and, the two-hole lever are connected to the earthing switch-side curved link are axi-symmetric with respect to the bisector, both the disconnecting switch and the earthing switch are in an open state, when the two-hole lever moves at a predetermined angle from the open state to the disconnecting switch-side, the disconnecting switch is in a closed state, and when the two-hole lever moves at a predetermined angle from the open state to the earthing switch-side, the earthing switch is in a closed state.

2. The disconnecting switch with earthing switch according to claim 1, wherein a sliding friction reducing member is disposed on the each inner circumferential surface of the disconnecting switch-side conductor and the earthing switch-side conductor on which the disconnecting switch-side moving contact and the earthing switch-side moving contact slide.

* * * * *

UNITED STATES PATENT AND TRADEMARK OFFICE

CERTIFICATE OF CORRECTION

PATENT NO. : 8,487,203 B2
APPLICATION NO. : 13/182109
DATED : July 16, 2013
INVENTOR(S) : T. Shin et al.

It is certified that error appears in the above-identified patent and that said Letters Patent is hereby corrected as shown below:

On the Title Page: Item (73) Assignee: should read: -- Hitachi, Ltd., Tokyo (JP) --

Signed and Sealed this
Seventeenth Day of September, 2013

Teresa Stanek Rea
*Deputy Director of the United States Patent and Trademark Office*